US007226230B2

(12) United States Patent
Liberatore

(10) Patent No.: US 7,226,230 B2
(45) Date of Patent: Jun. 5, 2007

(54) SPREADER

(76) Inventor: Raymond Liberatore, 12143 Punkin Hollow Rd., Bentonville, AR (US) 72712

( * ) Notice: Subject to any disclaimer, the term of this patent is extended or adjusted under 35 U.S.C. 154(b) by 0 days.

(21) Appl. No.: 10/750,447

(22) Filed: Dec. 30, 2003

(65) Prior Publication Data

US 2005/0025560 A1 Feb. 3, 2005

Related U.S. Application Data

(63) Continuation-in-part of application No. 10/628,097, filed on Jul. 28, 2003.

(51) Int. Cl.

| | |
|---|---|
| ***B05C 11/00*** | (2006.01) |
| ***B43K 1/06*** | (2006.01) |
| ***B43K 23/12*** | (2006.01) |
| ***B43M 11/06*** | (2006.01) |
| ***B65D 25/40*** | (2006.01) |

(52) U.S. Cl. ..... 401/266; 401/265; 401/262; 401/183; 222/566

(58) Field of Classification Search ..... 401/5, 401/123, 124, 119, 118, 139, 183, 262, 266, 401/265; 222/213, 490, 527, 566
See application file for complete search history.

(56) References Cited

U.S. PATENT DOCUMENTS

| | | | | |
|---|---|---|---|---|
| 708,709 | A | | 9/1902 | Henneberry et al. |
| 817,890 | A | | 4/1906 | Williams |
| 1,085,566 | A | | 1/1914 | Glover |
| 1,604,786 | A | | 10/1926 | Rinaldi |
| 1,870,841 | A | | 8/1932 | Eckert |
| 1,994,890 | A | | 3/1935 | Kallenbach |
| 2,550,132 | A | * | 4/1951 | Woods ..... 222/490 |
| 2,716,251 | A | | 8/1955 | Pearce |
| 2,804,767 | A | | 9/1957 | Schoen |
| 2,888,695 | A | * | 6/1959 | Anderson et al. ..... 401/266 |
| 2,930,063 | A | | 3/1960 | Stull |
| 2,982,987 | A | * | 5/1961 | Knapp ..... 401/139 |
| 3,063,601 | A | * | 11/1962 | Hertz ..... 222/213 |
| 3,090,071 | A | * | 5/1963 | Le Brooy ..... 401/266 |
| 3,418,059 | A | * | 12/1968 | Robe ..... 401/266 |
| 3,963,357 | A | | 6/1976 | Crisp |
| 4,225,255 | A | | 9/1980 | Braun et al. |
| 4,693,623 | A | | 9/1987 | Schwartzman |
| 4,844,250 | A | * | 7/1989 | Holoubek et al. ..... 222/107 |
| 4,844,917 | A | | 7/1989 | DeLorimiere |
| 4,957,226 | A | | 9/1990 | Pacia |
| 5,033,650 | A | | 7/1991 | Colin et al. |
| 5,097,987 | A | | 3/1992 | Liberatore |
| 5,330,075 | A | | 7/1994 | Brown, Sr. |
| 5,377,874 | A | | 1/1995 | Brown |
| 5,588,560 | A | | 12/1996 | Benedict et al. |
| 5,685,457 | A | | 11/1997 | Liberatore |
| 5,797,692 | A | | 8/1998 | Poole et al. |
| 5,823,387 | A | | 10/1998 | Manadanas et al. |

(Continued)

FOREIGN PATENT DOCUMENTS

| | | |
|---|---|---|
| DE | 29 21 633 A1 | 12/1980 |
| GB | 1389205 | 4/1975 |

*Primary Examiner*—David J. Walczak
(74) *Attorney, Agent, or Firm*—Myers Wolin, LLC

(57) ABSTRACT

An apparatus is disclosed for use with an edible food dispenser. The apparatus has a nozzle and a spreader surface associated with the nozzle.

7 Claims, 7 Drawing Sheets

U.S. PATENT DOCUMENTS

| | | | | |
|---|---|---|---|---|
| 5,865,555 | A | | 2/1999 | Dawson |
| 5,890,630 | A | * | 4/1999 | Lobdell ..... 401/139 X |
| 5,902,060 | A | * | 5/1999 | Rodriguez ..... 401/139 X |
| 5,960,994 | A | | 10/1999 | Liberatore |
| 6,045,283 | A | | 4/2000 | Velasquez et al. |
| 6,076,712 | A | | 6/2000 | Esber et al. |
| 6,153,238 | A | | 11/2000 | Shannon |
| 6,247,618 | B1 | | 6/2001 | Liberatore |
| 2002/0000441 | A1 | | 1/2002 | Redmond |

* cited by examiner

SPREADER

CLAIM OF PRIORITY

This application is a continuation in part of U.S. Ser. No. 10/628,097 filed Jul. 28, 2003.

FIELD OF THE INVENTION

The present invention relates to flowable material spreaders for use on hand manipulatable dispensers, and more particularly to spreaders at the nozzle ends of such dispensers.

BACKGROUND OF THE INVENTION

Spreadable foods are common table items and are enjoyed by many all over the world. There are numerous types of foods that can be spread. Typical spreadable foods include peanut butter, frosting, butter, mayonnaise, jelly, ice cream toppings, salad dressing and cream cheese and other edible spreads for use on bread, crackers, and the like. Often, a butterknife, spatula, or other similar device is used to spread the food onto the bread, cracker, or other item. However, these utensils can become lost on or at outdoor celebrations and picnics, or other events, or need to repeatedly dip a spreader knife into a jar. Additionally, material accumulates on the knife and jar edges, as well as crumbs of other materials can accumulate in the jar.

A number of patents have issued related to food dispensers and the like. U.S. Pat. No. 5,377,874 discloses a liquid dispenser for dispensing fluid condiment materials, such as ketchup, mustard and mayonnaise as well as other liquids such as medicated salves, lotions and ointments. The dispenser includes a tubular body with a spherical plunger element connected to a spreader paddle member disposed within a tubular body. Upon external manipulation of the tubular body, the spherical plunger and spreader paddle arrangement is urged toward a dispenser nozzle for release of condiment filling contained therein. The sanitary spreader paddle simultaneously protrudes from within the tubular body as condiment filling is being evacuated. As a result, the user may evacuate the entire volume of condiment filling within the dispenser as well as spread the deposited condiment filling on a food article to be eaten. In a medical application of the invention, the dispenser includes an integral applicator swab which is connected to the spreader paddle and resides within the plunger. The spreader paddle is separated from the plunger to expose the cleansing swab for use on the body.

U.S. Pat. No. 5,330,075 is directed to a food condiment dispenser for dispensing fluid condiment materials, such as ketchup, mustard and mayonnaise. The dispenser includes a tubular body with a spherical plunger element connected to a spreader paddle member disposed within a tubular body. Upon external manipulation of the tubular body, the spherical plunger and spreader paddle arrangement is urged toward a dispenser nozzle for release of condiment filling contained therein. The sanitary spreader paddle simultaneously protrudes from within the tubular body as condiment filling is being evacuated. As a result, the user may evacuate the entire volume of condiment filling within the dispenser as well as spread the deposited condiment filling on a food article to be eaten.

U.S. Pat. No. 4,957,226 is directed to an automatic food dispensing method, apparatus and utensil primarily for use in fast food restaurants, bakeries, and the like. The method and apparatus comprise a pumping system from a supply through a pump in a controlled amount with a reverse action of the pump after the appropriate amount has been dispensed in order to avoid it dripping. Other drip proof arrangements, such as valving are also utilized optionally. The utensil comprises a handle attached to a container and spreading utensil such as a spoon, ladle, or the like, wherein predetermined portions of a food or substance used in a food may be dispensed either continually or as predetermined quantities. The device consists of a spoon or other appropriately shaped utensil attached to a hollow handle which terminates in a non-interfering connection with the interior of the utensil at one end and terminates at the other end in a connection to a food supply source.

U.S. Pat. No. 6,153,238 is directed to a packaged cheese product comprising a hermetically sealed container, preferably a pouch, made out of flexible material; a decorator tip or adaptor therefore inside the container, a cheese product inside the container and a cap for closing the decorator tip when the pouch is partially emptied. The cheese product can be extruded after cuffing the corner off of the pouch and seating the decorator tip in the resulting opening. Cheese in decorative shapes can then be easily applied as a garnish on food items and the pouch can then be reclosed by capping the decorator tip. The cap preferably has a bulb member that fits inside the decorator tip and a skirt member that fits around the outside petals of the preferred decorator tip.

U.S. Pat. No. 4,844,917 is directed to a cake frosting technique and assembly including a disposable frosting bag for home or commercial use to render the frosting or decorating of cakes or other pastries more convenient and expeditious by the complete elimination of the need for expensive and messy heretofore-used large commercial squeeze bags, or manually whipped and spread frosting, or expensive aerosols. The invention contemplates the ready coloring or tinting of the frosting to any desired hue within a wide range with any particular color and further contemplates the imparting of any desired flavoring to the frosting by the separate and conveniently associated provision of the aforesaid disposable bag containing a neutral or white frosting along with a plurality of separate color tint tubes and a plurality of separate flavor taste tubes, whose contents are to be admixed respectively with the base frosting material to achieve a desired blend for the ultimate decorative and taste effects contemplated.

U.S. Patent Publication No. 2002/0000441 discloses an aperture forming structure, which when attached to or integrally formed in dispenser packages for flowable substances allows reclosure and single or multiple uses. The aperture forming structure includes a breakaway tip member of thermoformable plastic. The break away tip includes a hollow protrusion from a surface. The intersection of the hollow protrusion and the surface is a fault line. Rupturing of the fault line creates an aperture from which the contents of the dispenser package may exit. A cap may be integrally formed with the aperture forming structure and detached for protecting the hollow protrusion or for closing the aperture created when the fault line is ruptured. The aperture forming structure can be made by heating a relatively stiff substantially flat thermoformable sheet of and then stretching the sheet to create a first and a second hollow protrusion in a tiered configuration. A rupture line is placed at the intersection of the first and the second protrusions. The sheet may be attached to a pouch or containment member formed from a flexible sheet which contains any flowable substance.

While there have been a number of prior systems directed to food spreaders, none have adequately addressed the need for ease of use and convenience. There is a need for a system to easily, quickly and accurately spread material such as edible substances, being dispensed from containers such as squeeze tubes or bottles.

OBJECTS AND SUMMARY OF THE INVENTION

It is an object of the present invention to provide a spreader that will allow a user to spread a spreadable food item.

It is a further object of the present invention to provide a spreader having a dispensing nozzle associated with the dispenser to dispense said material, and a spreader surface associated with the nozzle whereby the dispenser may be manipulated to cause the spreader surface to spread material dispensed via the nozzle.

It is a further object of the present invention to provide a system in which the spreader is flexible and can be viewed in use.

It is yet a further object of the present invention to provide a spreader, including a container, having a base and a lid opposite the base, the container capable of holding a spreadable food item; a detachable handle mounted on the container; a plunger, adapted to engage the detachable handle such that when the detachable handle is depressed, the plunger exerts pressure on the spreadable food item in the container; and a dispenser nozzle, mounted on the exterior of the container proximate to the base of the container, in fluid communication with the interior of the container such that the spreadable food item may be forced through the dispenser nozzle, the dispenser nozzle capable of being in a first position or a second position.

In accordance with a first aspect of the present invention, a novel spreader is disclosed. The novel spreader includes a dispensing nozzle associated with the dispenser to dispense said material, and a spreader surface associated with the nozzle whereby the dispenser may be manipulated to cause the spreader surface to spread material dispensed via the nozzle.

In accordance with another aspect of the present invention, a novel spreader is disclosed. The novel spreader includes a container, having a closed end and an open end, capable of holding a spreadable food item, and a nozzle, mounted at the open end of the container, and having an opening in fluid communication with the open end of the container such that the spreadable food item can flow through the opening of the nozzle.

In accordance with yet another aspect of the present invention, a novel spreader/dispenser is disclosed. The novel spreader/dispenser includes a container, having a base and a lid opposite the base, the container capable of holding a spreadable food item; a detachable handle mounted on the container; a plunger, adapted to engage the detachable handle such that when the detachable handle is depressed, the plunger exerts pressure on the spreadable food item in the container; and a dispenser nozzle, mounted on the exterior of the container proximate to the base of the container, in fluid communication with the interior of the container such that the spreadable food item may be forced through the dispenser nozzle, the dispenser nozzle capable of being in a first position or a second position. The nozzles of the present invention can be used to spread a large variety of items in a variety of formats

BRIEF DESCRIPTION OF THE DRAWINGS

The foregoing summary, as well as the following detailed description of a preferred embodiment of the present invention will be better understood when read with reference to the appended drawings, wherein.

DETAILED DESCRIPTION OF THE PREFERRED EMBODIMENT

Figure 1:
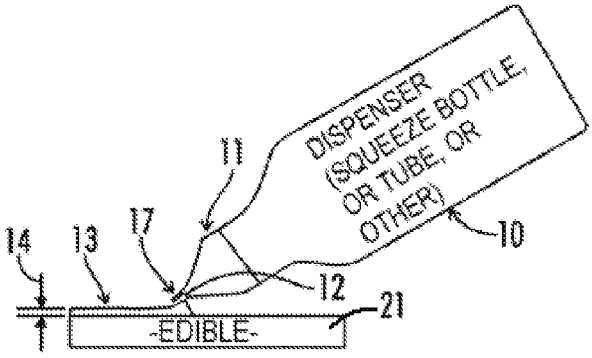
FIG. 1 is a side elevation of a spreader in accordance with the present invention.
Figure 2:
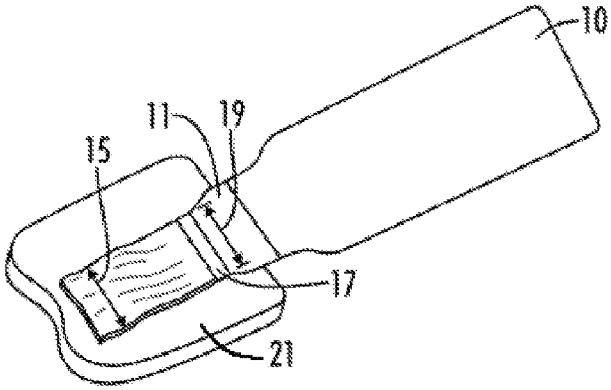
FIG. 2 is a perspective top plan view of the FIG. 1 spreader.

Referring now to the drawings, wherein like reference numerals refer to the same components across the several views and in particular to FIGS. 1 and 2, there is shown a spreader 10. The spreader 10 contains dispensable, flowable food material such as peanut butter, jelly or other such edibles. When the container is squeezed, the material flows through a nozzle 11 which tapers toward an outlet 12 which is elongated laterally, to provide a dispensed layer 13 of material of thickness 14 substantially less than its width 15. A flexible spreader 17 in the form of a flap or blade, or spatula, is provided at the nozzle exit, to face the layer 13 exiting from the nozzle, whereby the user can manipulate the spreader, and its undersurface, via container manipulation, to further spread or shape the dispensed layer 13. The flap or blade may be stiff or sufficiently flexible to shape the layer 13. Note its lateral length 19 is substantially greater than its width. The tip of the nozzle or blade should be flexible.

Figure 4:
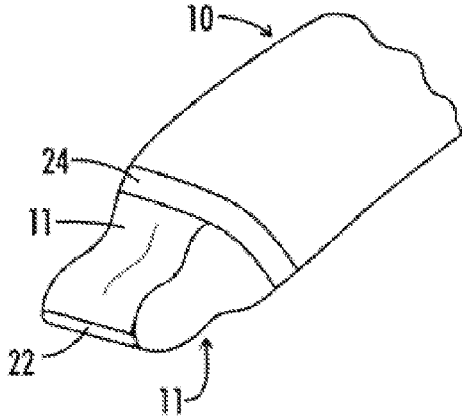
FIG. 4 is a view like FIG. 2 but showing a spreader flexible dispensing nozzle.
Figure 4A:
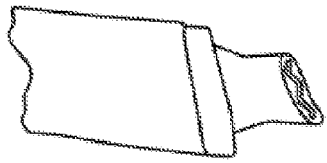
FIG. 4*a* is a spreader flexible dispensing nozzle having a wavy texture.
Figure 3:
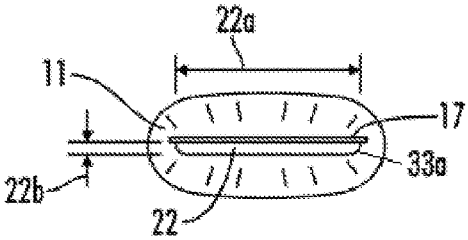
FIG. 3 is a front elevation of a spreader dispensing opening.

The nozzle 11 may be stiff or may be flexible as in FIG. 4 to assist flexing of the spreader during container manipulation to cause the spreader to shape the layer 13 deposited on a surface 21 or spread it only after it is dispensed. The latter may be a food surface such as on bread, or other substances. FIG. 3 shows the nozzle outlet 22, which has lateral width 22*a* substantially greater than its thickness 22*b*. The nozzle may be a cap on the container, or may be integral with the container. A snap-on or threaded fitting 24 connects the nozzle to the container, in FIG. 4. As shown in FIG. 4*a*, the extruded product can have a wavy texture.

Figure 5:
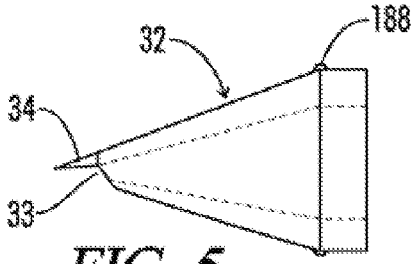
FIG. 5 is a side elevation of a spreader nozzle.
Figure 6:
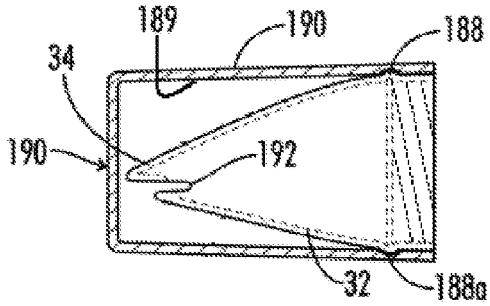
FIG. 6 is a top plan view of a spreader cap.
Figure 7:
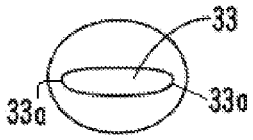
FIG. 7 is a view of an entrance at the inlet end of a spreader as in FIG. 5.
Figure 8:
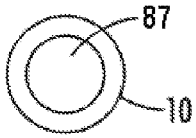
FIG. 8 is like FIG. 7, showing a different entrance configuration.
Figure 9:
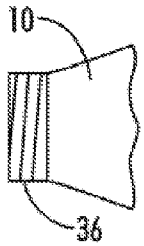
FIG. 9 is a side elevation showing the end of a container to which a spreader cap attaches.
Figure 10:
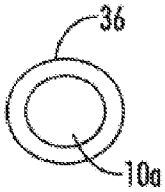
FIG. 10 is a frontal view of the FIG. 9 container end.

FIGS. 5 and 6 show a nozzle 32, tapering toward a narrowed exit 33 with a spreader flap or blade 17 overhanging that exit. The blade 17 is preferably flexible. See also the arcuate and concave surfaces 33*a* at widthwise opposite ends of the opening or exit 33, which remain of fixed dimension as shown, and which assist in aiding spreading of the extruding product. FIG. 6 shows a cap 190 that receives the nozzle with snap-ring retention at 188 in a cap recess 188*a* of Cap inner wall 189 forms a recess to receive the nozzle. A plug 192 on the cap plugs outlet 33. FIG. 7 shows the exit 33 as laterally, elongated with narrowed width or height. The nozzle entrance is seen at 34, in FIG. 8. FIG. 9 shows dispenser threads 36 to which the nozzle may threadably or otherwise attach. FIG. 10 shows in frontal view the annular end of the thread 36. See end opening 10*a*.

Figure 11:
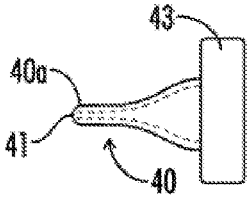
FIG. 11 is a side elevation showing a spreader or narrowed configuration.
Figure 12:
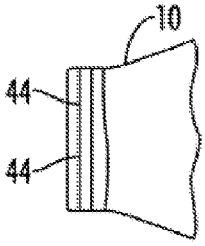
FIG. 12 is a side elevation of the discharge end of a container to which the FIG. 11 spreader attaches.

FIG. 11 shows a flexible nozzle 40 that tapers toward an outlet 41, such as an elongated slit. The nozzle tip 40*a* serves as a spreader and preferably is positioned so that it can be seen when in use. The nozzle has a fitting 43 that threadably attaches to dispenser threads 44, as seen in FIG. 12. Nozzle may alternatively be positioned via a snap and release mechanism.

Figure 13:
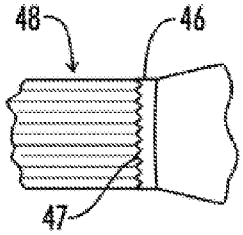
FIG. 13 is a top plan view of a spreader discharge end, with a serrated edge.
Figure 14:
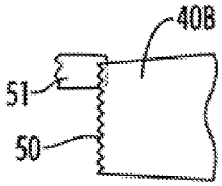
FIG. 14 is a view like FIG. 13 showing a nozzle discharge end with serrated edge.

FIG. 13 shows a spreader flap 46 that has a laterally elongated serrated edge 47 to engage the dispensed layer 48 being dispensed. As a result, the layer 48 has an attractive striated appearance. The nozzle can be waved laterally back and forth to produce wavy elongated striations on the dispensed layer surface. FIG. 14 shows similar serrations 50 on the end of a nozzle 40*b*. A flap 51 can be attached to the nozzle to overlie the serrations, or part of same.

Figure 15:
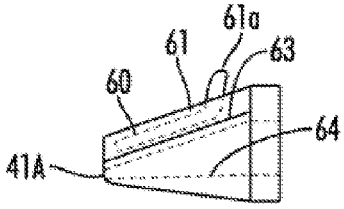
FIG. 15 is a side elevation showing a nozzle with a retracted movable spreader, and control.
Figure 16:
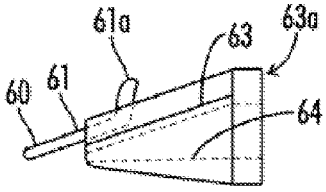
FIG. 16 is a view like FIG. 15, showing the movable spreader in extended position.
Figure 17:
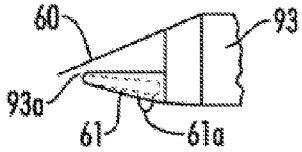
FIG. 17 is like FIG. 15 but showing the movable retractable spreader at the underside of the nozzle.
Figure 18:
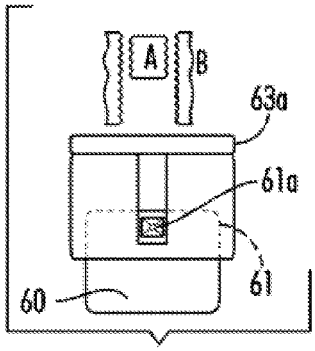
FIG. 18 is a top plan view of a nozzle with an associated retractable and extendable spreader.

In FIG. 15, the flap or blade 60 is carried for adjustable movement, as by a carrier or adjuster 61 on the nozzle. A finger engagable protrusion 61*a* on the carrier is manipulated to move or slide the blade and carrier toward or away from the nozzle exit 41*a*, thereby to adjust the exposure of the blade to the dispensed material, to provide additional flexibility of use of the blade. Grooving 63 in the nozzle in the form of a threaded cap 63*a*, guides the adjuster. FIG. 16 shows the blade in extended forward position. The dispensing nozzle cavity appears at 64. FIG. 18 is a top plan view of the FIG. 16 adjuster. FIG. 17 shows the adjuster at the bottom side of the nozzle 93, having an exit 93*a* and pusher. The option of depositing the layer 113 without interference with the spreader flap or blade, is preserved.

Figure 19:
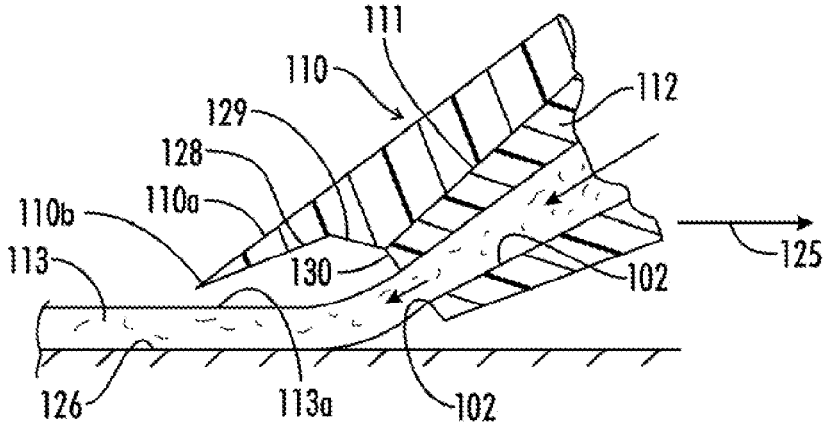
FIG. 19 shows a modified nozzle and spreader.

In FIG. 19 a spreader 110 blade or flap 110*a* carried at 111 by, and may be fixedly or releasably attached to or integral with, a nozzle 112. See bond zone at 111. The spreader and nozzle are shown being moved to the right. See arrow 125, and a layer of dispensable material 113 is deposited on substrate 126, via bore 112*a* of the nozzle. Material 113 is typically edible, and may consist, for example, of peanut butter, butter, frosting, mayonnaise, jam, jelly, soft cheese, or other edibles.

In FIG. 19, the spreader 110 as supported is angled, relative to the nozzle or its bore, so that the spreader flap terminal 110*a* is sufficiently offset from the nozzle outlet 112*a* by a sufficient distance, that the terminal tip 110*b* does not engage the top 113*a* of the deposited layer 113, as during depositing of the layer. Terminal 110*a* may consist of an elastomer such as rubber. Outlet 112*a* may be laterally elongated as in FIG. 7.

Figure 19A:
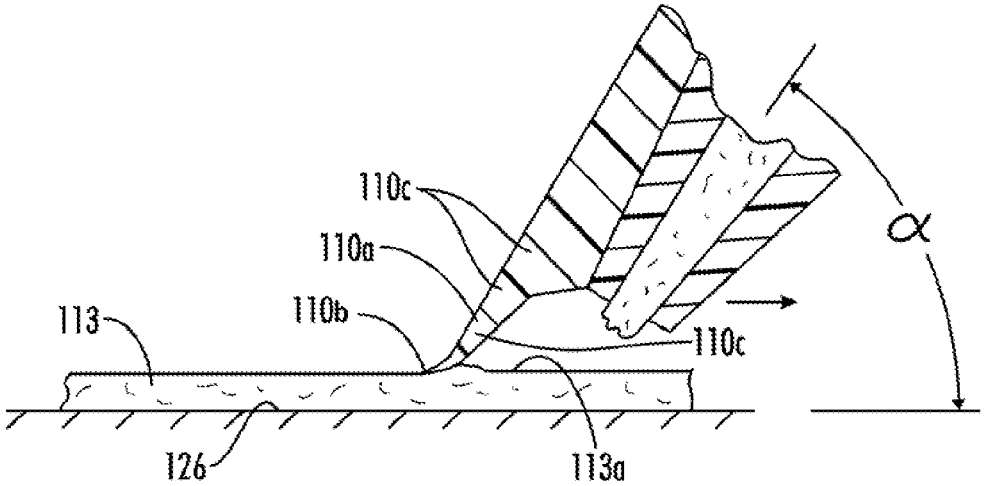
FIG. 19*a* shows the FIG. 19 spreader in tilted position, for spreading use.

In FIG. 19*a* the nozzle is now further tilted, as at angle a, so that the spreader blade terminal tip 110*a* engages the surface of the layer 113, for spreading purposes. Terminal 110*a* is shown as arcuately flexed near the tip, to smoothly engage and spreadably deform surface 113*a*, as the nozzle is moved to the right, relative to 113. Note that the spreader body at 110*c* upwardly of terminal 110*a* is thickened so as not to flex, and so as to positively position the terminal 110*a* as it accurately wipes along surface 113*a*. Terminal 110*a* may or may not be flexible, but is preferably arcuately flexible to smooth and spread surface 113*a*, as the nozzle and supply container are manipulated.

Body 110*c* tapers toward the tip or terminal. This construction, as shown, lends itself to ease of cleaning of interior surfaces 128, 129, and 130, as well as cleaning of the terminal. Note the greater than 90 degrees angularities of adjacent surfaces 128 and 129, and 129 and 130, avoiding small gaps. The spreader terminal at 110*a* may have elongated lateral length, of dimension substantially greater than the nozzle discharge opening dimension, as described above in other FIGURES, for engaging the widened surface area of 113, achieved during spreading.

Figure 20:
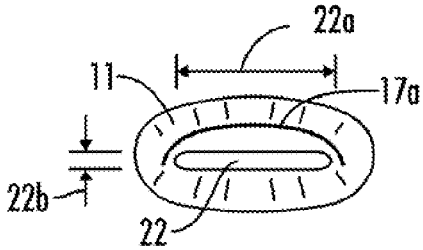
FIG. 20 shows a curved flap or blade.

FIG. 20 shows a curved flap or blade to conform to curvature of an edible, such as a corn cob. See laterally elongated nozzle outlet 22 having narrowed width 22*b*. A downwardly concave spreader flap or blade 17*a* is shown as above the outlet 22, and of lateral elongation greater than outlet 22 lateral elongation, indicated at 22*a*.

Figure 21A:
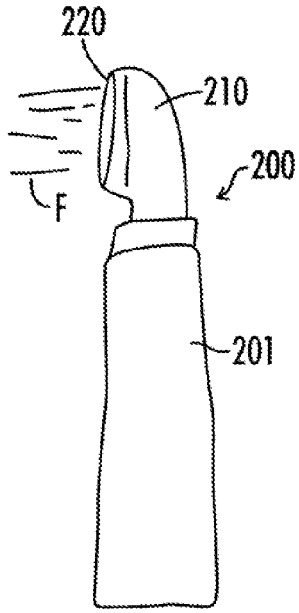
FIG. 21*a* is a side elevation of an alternate embodiment of a spreader outfitted with a knife nozzle in accordance with the present invention.

FIG. 21*a* shows an alternate embodiment of the present invention that combines a knife and a spreader 200. The spreader 200 includes a container 201, that can hold a spreadable food F, such as peanut butter, butter, cheese, and the like. In a preferred embodiment of the present invention, the container 201 is flexible so as to allow a user to squeeze the spreadable food F. A knife nozzle 210 is attached to an open end of the container 201, and has an opening 220 to allow the spreadable food F to be transferred from the container 201 to an item such as bread, crackers, and the like. The knife nozzle 210 can then be used to spread the spreadable food F as desired.

Figure 21B:
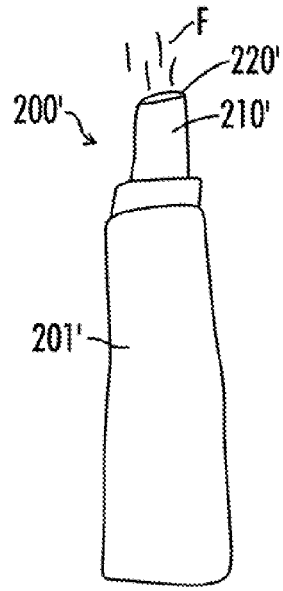
FIG. 21*b* is a side elevation of an alternate embodiment of a spreader outfitted with a spatula nozzle in accordance with the present invention.

FIG. 21*b* illustrates another embodiment of the present invention that combines a spatula and a spreader 200'. The spreader 200' includes a container 201', very similar to the container 201 above, that can hold a spreadable food F, such as peanut butter, butter, cheese, and the like. In a preferred embodiment of the present invention, the container 201' is flexible so as to allow a user to squeeze the spreadable food F. A spatula nozzle 210', which may be flexible, is attached to an open end of the container 201', and has an opening 220' to allow the spreadable food F to be transferred from the container 201' to an item such as bread, crackers, and the like. The spatula nozzle 210' can then be used to spread the spreadable food F as desired.

Figure 22A:
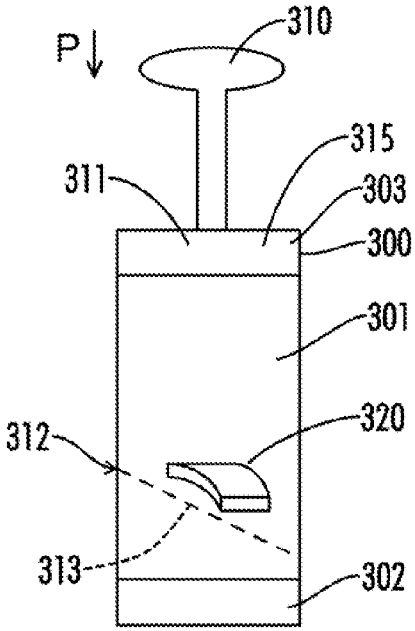
FIG. 22*a* is a front elevation view of an alternate embodiment of a spreader/dispenser in accordance with the present invention.
Figure 22B:
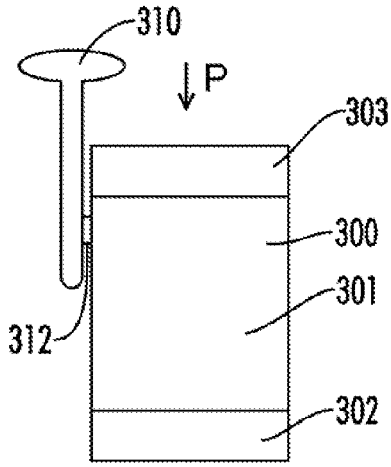
FIG. 22*b* is a partial front elevation view of the spreader/dispenser of FIG. 22A in an alternate configuration.

Referring now to FIGS. 22*a* and 22*b*, another embodiment of a spreader 300 is illustrated. The spreader 300 includes a container 301, having a base 302 and a lid 303, that can hold a spreadable food F, such as peanut butter, butter, cheese, and the like. A detachable handle 310 is mounted on the container 301 at an attachment point 312 for transport and storage, to allow the spreader 300 to have less of a profile and take up less room. A dispenser nozzle 320 is mounted on the exterior of the container 301 to allow for the spreadable food in the container to be pushed out and onto a receiving food, such as bread, crackers and the like. When the spreader 300 is to be used, the detachable handle 310 is detached from the attachment point 312 and is mounted at mounting point 311, where it comes into engagement with a plunger 315, located in the lid 303. Additionally, the dispenser nozzle 320 may be rotated up or down, or flipped up in order to facilitate dispensing or storage as the case may be. When the handle 310 is depressed in the direction of arrow 'P', then the handle 310 exerts downward pressure on the spreadable food in the container 301, and forces the spreadable food out of the dispenser nozzle 320, and onto the receiving food. The interior of the dispenser is beveled 313 to facilitate the removal of all material. While this embodiment has been described in the context of a longitudinally thrust plunger, it is to be appreciated that other equivalent structures could fulfill this function. For example the plunger could be thrust downward by means of a screw activated compression mechanism.

Figure 23:
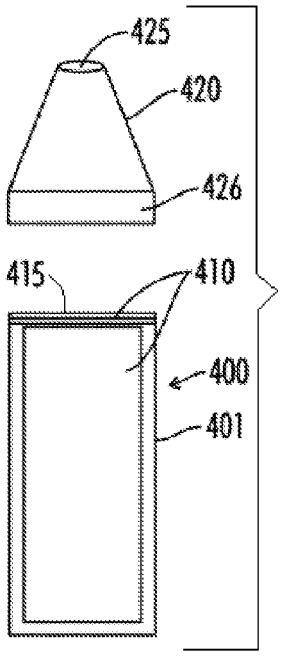
FIG. 23 is an exploded view of an alternate embodiment of a spreader and nozzle in accordance with the present invention.

Illustrated in FIG. 23 is another embodiment of a spreader 400. The spreader 400 includes a container 401 and a nozzle 420. The container includes a threaded end 415 and is capable of receiving a bag 410, which in turn holds a spreadable food such as peanut butter, butter, cheese, frosting, and the like. The bag 410 may be omitted altogether. The bag 410 is flexible in a preferred embodiment of the present invention and can be folded over the threaded end 415 of the container 401. The nozzle 420 includes an opening 425 and a threaded end 426 which threadedly engages the threaded end 426 of the container 401 to secure the nozzle 420 to the container 401. Additionally, the bag 410 is then secured into place as the overlap portion is secured between the threaded end 426 of the nozzle 420 and the threaded end 426 of the container 401.

Figure 24:
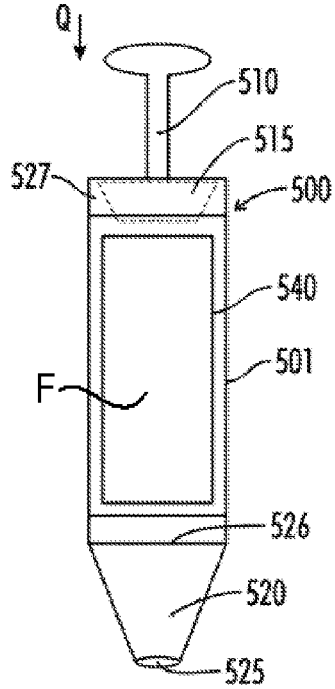
FIG. 24 is a front elevation view of an alternative embodiment of a spreader with a nozzle and handle in accordance with the present invention.
Figure 25:
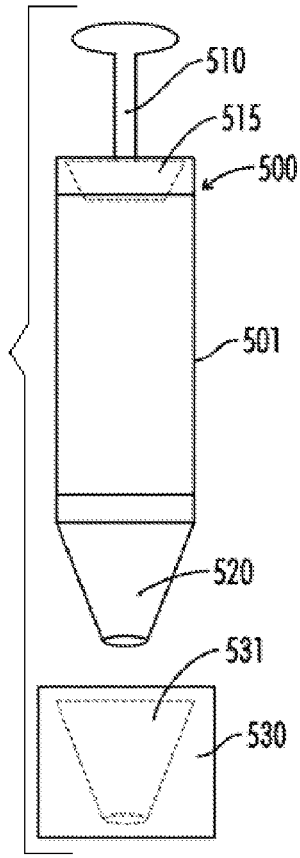
FIG. 25 is a front elevation view of the spreader of FIG. 24 shown with a cap for the nozzle.

Referring now to FIGS. 24 and 25, another embodiment of a spreader 500 is shown. The spreader 500 includes a container 501, and a wide nozzle 520. Disposed within the container 501 is a bag 540 that can hold a spreadable food F, such as peanut butter, butter, cheese, frosting, and the like. The wide nozzle 520 is mounted at an open end 526 of the container 501, and includes an opening 525. Mounted on the container 501, at the opposite end 527 is a handle 510. The handle 510 includes a plunger 515, such that when the handle 510 is depressed in the direction of arrow 'Q', the plunger 515 forces the spreadable food contained within the bag 540 out through the opening 525 of the wide nozzle 520 and onto a receiving food, such as bread, crackers, cake, and the like. Additionally, a cap 530, having a cavity 531 substantially in the shape of the wide nozzle 520, can be mounted on the container 501 at the wide nozzle 520 in order to allow the spreader 500 to be stored standing upright.

Figure 26:
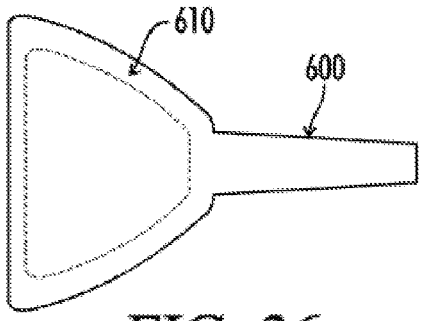
FIG. 26 is a further alternative embodiment of a nozzle.

FIG. 26 illustrates yet another embodiment of a nozzle in accordance with the present invention. In this embodiment, a rubber or flexible nozzle 600 is affixed to a threaded member 610 and extended coaxially thereto. The rubber/plastice nozzle 600 can function as a "spreader, and is attachable to container 601"

Figure 27:
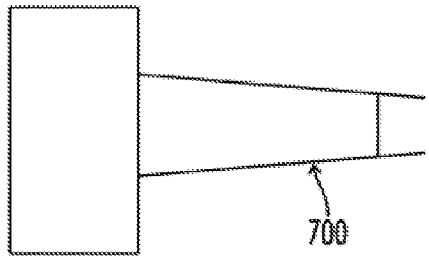
FIG. 27 is still yet a further embodiment of the nozzle of the present invention.

FIG. 27 is still a further embodiment of nozzles in accordance with the present invention. FIG. 27 illustrates a nozzle 700 which either may be stiff or comprise a member expandable in accordion style when pressure is applied.

Figure 28A:
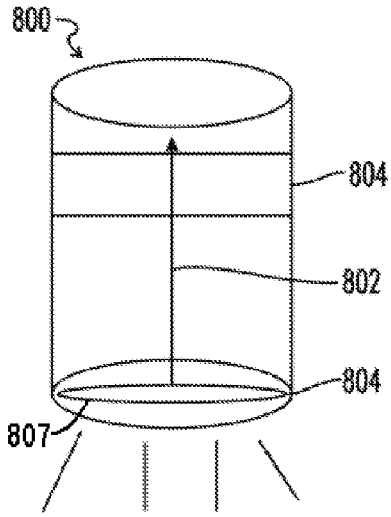
FIGS. 28*a*–28*b* are another embodiment of the nozzle spreader of the present invention.
Figure 28B:
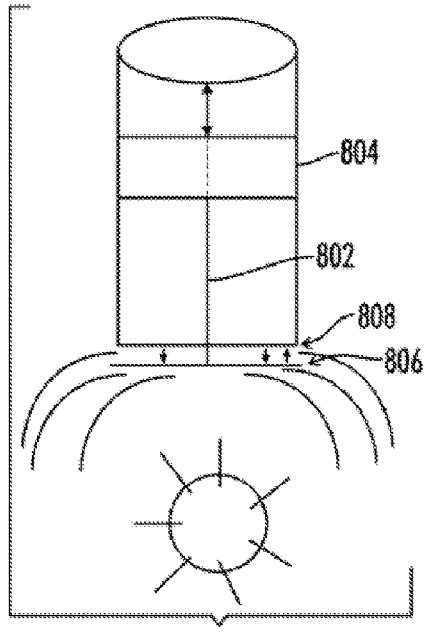

FIGS. 28*a* and 28*b* are still yet a further embodiment of a spreader in accordance with the present invention. In this embodiment, the spreader is a cylindrical casing 800 with an adjustable spine 802, connected to an adjustment mechanism 804 and nozzle 807 permit the flow of condiments such as spread dressing. It is to appreciated that the adjustment mechanism 804 may comprise a drive screw or other similar device to longitudinally move the nozzle 807. The nozzle 807 may have holes to permit the flow of material therethrough. When the adjustment mechanism 804 is pulled upward the nozzle 807 pulls upward and permits the flow of material. When pressure is applied the nozzle extends stiffly outward. This embodiment is similar in its operation to a garden nozzle. In a modified embodiment shown in FIG. 28*b*, the mechanism can have two positions, "on" and "off" 806, 808.

Figure 29:
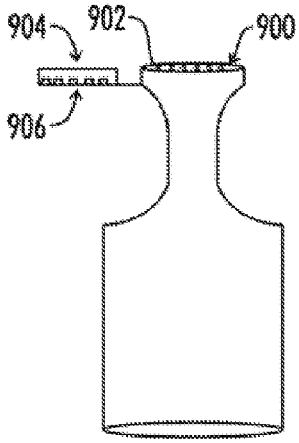
FIGS. 29 and 29*b* is another embodiment of the nozzle spreader of the present invention.
Figure 29A:
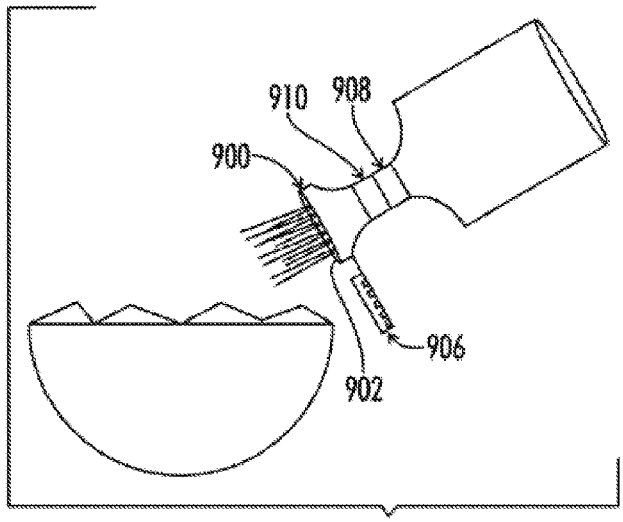

FIGS. 29 and 29*a* illustrate yet another nozzle spreader embodiment. In this embodiment, the nozzle spreader comprises a flat, wide nozzle 900 having a plurality of shaped holes 902. The nozzle can have a flip cap 904, for example, and may have a cap or closure which has protrusions 906 to cover the holes. This embodiment is ideal for salad dressings or the like. As shown in FIG. 29*a*, the bottle can have a threaded attachment 908 and adjuster 910 to adjust the flow of material.

Figure 30:
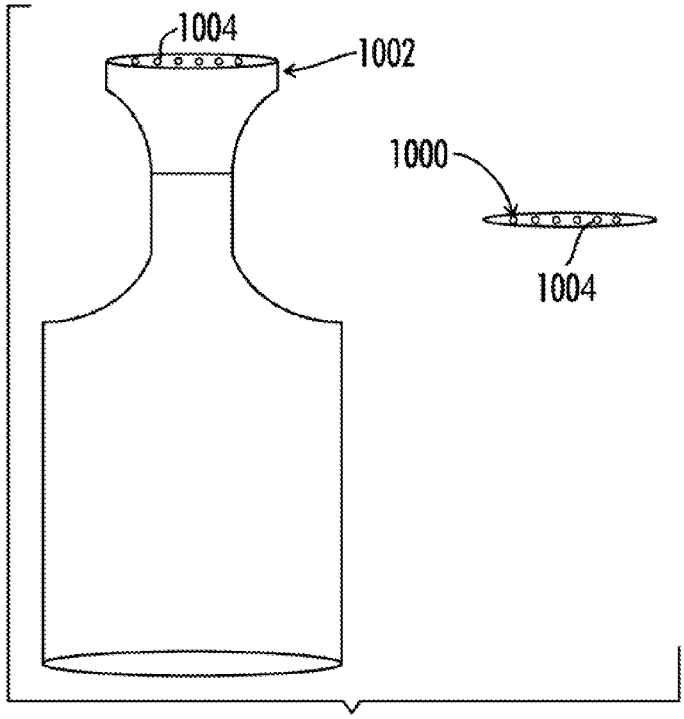
FIG. 30 is another embodiment of the nozzle spreader of the present invention; and, FIGS. 31 and 31*a* are another embodiment of the nozzle spreader of the present invention.

FIG. 30 is a related embodiment to that of FIG. 29. In this embodiment, the nozzle comprises a flat, wide nozzle 1000 that inserts on a wide flange top 1002. The nozzle has a plurality of holes 1004 which may be beveled outward. The number, shape and position of the holes can be varied. This embodiment is ideal, for example, for ice cream toppings and salad dressings and other viscous food products. In a preferred embodiment, this bottle is a unitary structure including the novel flange top.

Figure 31:
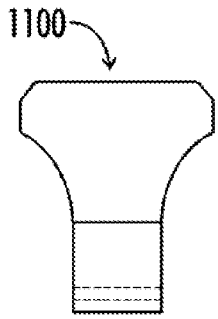
Figure 31A:
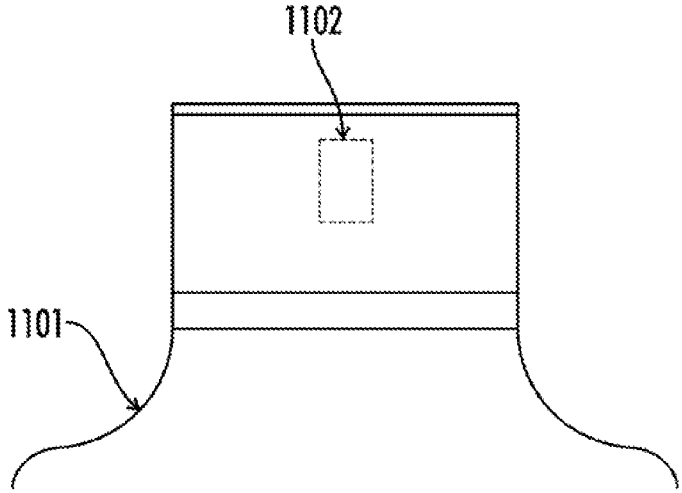

Finally, FIGS. 31 and 31*a* illustrate yet another nozzle embodiment. In this embodiment, the nozzle/spreader comprises a wide but narrow slit flange 1100 which is affixed to the bottle or tube 1101. The corners of the nozzle can be straight or cornered. This embodiment may include an internal support or stilt 1102 to prevent the nozzle from collapsing.

In view of the foregoing disclosure, some advantages of the present invention can be seen. For example, a novel spreader has been disclosed. The novel spreader easily, quickly and accurately spreads material such as edible substances, being dispensed from containers such as squeeze tubes or bottles.

While the preferred embodiment of the present invention has been described and illustrated, modifications may be made by one of ordinary skill in the art without departing from the scope and spirit of the invention as defined in the appended claims. For example, in a preferred embodiment of the present invention, the bags 410 and 540 may be polybags, however, the bags may be of any type known to one of ordinary skill in art. Additionally, the method of securing the nozzles to the containers has been described and illustrated as being via a threaded engagement. However, a skilled artisan may employ any appropriate means to attach the nozzles to the containers, such as, but not limited to, a snap connection or molded piece.

The invention includes the following, as for example is disclosed above and in the drawings:

A flowable edible material mass progressive dispenser comprising:

a) a spreader having a longitudinally forwardly elongated container for said mass, said container having an end wall, b) a nozzle projecting generally forwardly from said end wall, and having a side wall that extends forwardly and terminates at a furthest forward end opening through which said mass is dispensed, c) said end opening defining a periphery having a lateral width dimension, and a height dimension that remains substantially the same throughout the lateral width extent of said end opening, said lateral width dimension substantially exceeding twice said height dimension of said end opening, for spreading the mass of material being dispensed, the spreader having a surface acting to spread said material being dispensed via the nozzle end opening, d) said nozzle side wall having an outer surface that is everywhere forwardly convergent toward said end opening periphery to define forward taper as it peripherally and forwardly approaches said nozzle end opening, e) whereby a substantially constant height layer of said mass is dispensed forwardly through said nozzle end opening as the mass in the container is pressurized, and said layer has the width of said end opening, f) said forward taper acting to terminally narrow the nozzle and configure it for ease of spreading said dispensed layer.

What is claimed is:

1. A flowable edible material mass progressive dispenser comprising in combination:

a) a container for said mass, said container having an end wall, b) a nozzle projecting generally forwardly from said end wall, and having a side wall that extends forwardly and terminates at a furthest forward end opening through which said mass is dispensed, c) said end opening defining a periphery having a lateral width dimension and a height dimension, said lateral width dimension substantially exceeding twice said height dimension of said end opening, for spreading the mass of material being dispensed, the dispenser having surfaces including arcuate and concave surfaces at widthwise opposite ends of said opening, which remain of fixed dimension, and d) said nozzle side wall having a peripheral outer surface comprised of an upper wall, a lower wall and two sidewalls, wherein the entire exposed portion of at least the upper wall and the lower wall of said peripheral outer surface comprises a concave surface positioned between two convex surfaces, at least one of the convex surfaces of each of the upper and lower walls terminating at the opening and having substantially the same convex curvature, e) whereby a substantially constant height layer of said mass is dispensed forwardly through said nozzle end opening as the mass in the container is pressurized, and said layer has the width of said end opening.

2. A dispenser in accordance with claim 1, further comprising a cap for covering said nozzle.

3. A dispenser in accordance with claim 2 wherein the height dimension of the end opening remains substantially the same throughout the lateral width extent of said end opening.

4. A flowable edible material mass progressive dispenser comprising in combination:

a) a longitudinally forwardly elongated container for said mass, said container having an end wall, b) a nozzle projecting generally forwardly from said end wall, and having a side wall that extends forwardly and terminates at a furthest forward end opening through which said mass is dispensed, c) said end opening defining a periphery having a lateral width dimension, and a height dimension that remains substantially the same throughout the lateral width extent of said end opening, said lateral width dimension substantially exceeding twice said height dimension of said end opening, for spreading the mass of material being dispensed, the dispenser having surfaces including arcuate and concave surfaces at widthwise opposite ends of said opening, which remain of fixed dimension, acting to spread said material being dispensed via the nozzle end opening, d) said nozzle side wall having a peripheral outer surface comprised of an upper wall, a lower wall and two sidewalls, that is everywhere forwardly convergent toward said end opening periphery to define forward taper as it peripherally and forwardly approaches said nozzle end opening, wherein the entire exposed portion of said upper wall consists of a concave surface positioned between two convex surfaces, e) whereby a substantially constant height layer of said mass is dispensed forwardly through said nozzle end opening as the mass in the container is pressurized, and said layer has the width of said end opening, f) said forward taper acting to terminally narrow the nozzle and configure it for ease of spreading said dispensed layer and, g) a cap for covering the nozzle.

5. A dispenser in accordance with claim 4, wherein the cap farther comprises a plug for plugging the opening.

6. A dispenser in accordance with claim 5, wherein a portion of the cap extends around the end opening.

7. A dispenser in accordance with claim 5, wherein a portion of the plug extends into the end opening.

* * * * *